US011571631B2

(12) United States Patent
De La Torre et al.

(10) Patent No.: US 11,571,631 B2
(45) Date of Patent: Feb. 7, 2023

(54) TOY VEHICLE PLAYSET WITH STUNT LOOP APPARATUS

(71) Applicant: Mattel, Inc., El Segundo, CA (US)

(72) Inventors: Gabriel De La Torre, Los Angeles, CA (US); Alex Au, Kowloon (HK)

(73) Assignee: Mattel, Inc., El Segundo, CA (US)

( * ) Notice: Subject to any disclaimer, the term of this patent is extended or adjusted under 35 U.S.C. 154(b) by 464 days.

(21) Appl. No.: 16/785,836

(22) Filed: Feb. 10, 2020

(65) Prior Publication Data

US 2020/0261816 A1 Aug. 20, 2020

Related U.S. Application Data

(60) Provisional application No. 62/805,499, filed on Feb. 14, 2019.

(51) Int. Cl.
*A63H 18/02* (2006.01)

(52) U.S. Cl.
CPC ..... *A63H 18/028* (2013.01); *A63H 18/023* (2013.01)

(58) Field of Classification Search
CPC .... A63H 18/02; A63H 18/023; A63H 18/025; A63H 18/026; A63H 18/028; A63H 18/06
USPC ..... 446/431, 444; 238/10 C, 10 E, 10 R, 238/10 A; 104/53, 55
See application file for complete search history.

(56) References Cited

U.S. PATENT DOCUMENTS 1,527,006 A * 2/1925 O'Reilly ..... A63H 18/028 104/55
1,723,656 A * 8/1929 Palmigiano, Jr. .... A63H 18/028 104/77
2,756,687 A * 7/1956 Fields ..... A63H 18/04 446/444
3,209,491 A * 10/1965 Roeper ..... A63H 18/028 238/10 R
3,600,849 A * 8/1971 Faller ..... A63H 18/14 446/429
3,633,308 A * 1/1972 Yang ..... A63H 18/14 446/423
4,203,247 A * 5/1980 Moe ..... A63H 17/008 446/429
4,312,149 A * 1/1982 Iwao ..... A63H 18/00 446/449
4,394,961 A * 7/1983 Muller ..... A63H 18/028 238/10 F
4,516,953 A * 5/1985 Hippely ..... A63H 18/028 446/444

(Continued)

*Primary Examiner* — Alexander R Niconovich
(74) *Attorney, Agent, or Firm* — Edell, Shapiro & Finnan, LLC

(57) ABSTRACT

A toy vehicle playset comprises a stunt loop apparatus. The stunt loop apparatus has a support, a partial loop portion coupled to the support, and an arcuate portion rotatably coupled to the support. The partial loop portion has an opening and the arcuate portion is configured to rotate between an inlet position and an outlet position within the opening. By rotating the arcuate portion from the inlet position to the outlet position, a continuous pathway is formed that allows a toy vehicle to sequentially travel along the arcuate portion in the inlet position, the partial loop portion, and then the arcuate portion in the outlet position.

20 Claims, 11 Drawing Sheets

(56) References Cited

U.S. PATENT DOCUMENTS 4,564,197 A * 1/1986 Lambert ..... A63H 17/008 463/64
5,102,133 A * 4/1992 Chilton ..... A63H 18/028 238/10 F
5,174,569 A * 12/1992 Ngai ..... A63H 18/023 104/304
5,299,969 A * 4/1994 Zaruba ..... A63H 18/028 238/10 C
5,899,789 A * 5/1999 Rehkemper ..... A63H 18/00 446/431
6,358,112 B1 * 3/2002 Lambert ..... A63H 18/028 238/10 C
6,478,654 B1 * 11/2002 Rehkemper ..... A63H 18/028 104/53
6,676,480 B2 * 1/2004 Sheltman ..... A63H 18/02 446/431
6,783,419 B1 * 8/2004 Paukert ..... A63H 18/02 446/444
7,549,906 B2 * 6/2009 Bedford ..... A63H 18/025 104/54
7,614,931 B2 * 11/2009 Nuttall ..... A63H 18/026 446/423
7,690,964 B2 * 4/2010 Nuttall ..... A63H 18/028 446/168
7,794,301 B2 * 9/2010 Ostendorff ..... A63H 18/14 463/67
7,819,720 B2 * 10/2010 Nuttall ..... A63H 18/028 446/444
7,901,266 B2 * 3/2011 Ostendorff ..... A63H 18/04 104/53
8,298,038 B2 * 10/2012 O'Connor ..... A63H 18/02 446/444
8,567,690 B2 * 10/2013 De La Torre ..... A63H 18/06 446/444
8,870,623 B2 * 10/2014 Ferreyra ..... A63H 18/16 446/429
8,876,572 B2 * 11/2014 Martino ..... A63H 29/24 446/429
8,876,573 B2 11/2014 O'Connor
8,944,339 B2 * 2/2015 Ostendorff ..... A63H 18/026 238/10 E
8,944,881 B2 * 2/2015 Payne ..... A63H 18/028 446/444
8,951,091 B2 * 2/2015 Payne ..... A63H 17/008 446/444
8,986,068 B2 * 3/2015 Jourdian ..... A63H 18/021 446/444
9,314,704 B2 * 4/2016 Ostendorff ..... A63H 18/025
9,421,473 B2 * 8/2016 Ostendorff ..... A63H 18/023
9,452,366 B2 * 9/2016 Schmid ..... A63H 18/00
9,457,284 B2 * 10/2016 Ostendorff ..... A63H 18/00
9,707,489 B2 * 7/2017 Nuttall ..... A63H 18/02
10,213,702 B2 * 2/2019 Lennon ..... A63H 18/026
10,493,369 B2 * 12/2019 Schmid ..... A63H 18/08
10,596,476 B2 * 3/2020 Ostendorff ..... A63H 18/026
10,653,972 B2 * 5/2020 Welby ..... A63H 18/028
2003/0224697 A1 * 12/2003 Sheltman ..... A63H 18/00 446/444
2005/0287915 A1 * 12/2005 Sheltman ..... A63H 18/028 446/444
2010/0123017 A1 * 5/2010 O'Connor ..... A63H 18/028 238/10 R
2010/0273390 A1 10/2010 O'Connor
2011/0086574 A1 * 4/2011 Nuttall ..... A63H 18/028 446/444
2012/0309263 A1 * 12/2012 Lennon ..... A63H 18/06 446/444
2013/0231028 A1 9/2013 Ostendorff
2016/0310857 A1 * 10/2016 Effler ..... A63H 18/02

* cited by examiner

TOY VEHICLE PLAYSET WITH STUNT LOOP APPARATUS

CROSS-REFERENCE TO RELATED APPLICATION

This application claims the benefit of U.S. Provisional Patent Application No. 62/805,499, filed Feb. 14, 2019, entitled "Toy Vehicle Playset with Stunt Loop Apparatus," the entire disclosure of which is incorporated by reference herein.

FIELD OF THE INVENTION

The present invention relates generally to toy vehicle track sets and playsets, and in particular, loop apparatuses utilized in such track sets and playsets.

BACKGROUND OF THE INVENTION

Track sets and playsets for toy vehicles are enjoyed by children of all ages. A variety of elements and features have been developed over the years to enhance the amusement and entertainment value of such toy vehicle playsets. One popular feature is the inclusion of a loop track for a toy vehicle to travel along.

While there are numerous toy vehicle track sets and playsets in the art with loop tracks and other stunt features, there is still a need and demand for toy vehicle playsets that provide novel entertainment mechanisms. Embodiments of the present invention provide a toy vehicle playset that allows a toy vehicle to perform a loop without the need for a complete loop track.

SUMMARY OF THE INVENTION

In accordance with one or more embodiments of the present invention, a toy vehicle playset is provided that comprises a stunt loop apparatus. The stunt loop apparatus has a support, a partial loop portion coupled to the support, and an arcuate portion rotatably coupled to the support. The partial loop portion has an opening and the arcuate portion is configured to rotate between an inlet position and an outlet position within the opening. By rotating the arcuate portion from the inlet position to the outlet position, a continuous pathway is formed that allows a toy vehicle to sequentially travel along the arcuate portion in the inlet position, the partial loop portion, and then the arcuate portion in the outlet position.

In accordance with other embodiments of the present invention, a toy vehicle playset is provided that comprises a stunt loop apparatus having a support, a partial loop portion coupled to the support, and a rotating arcuate portion coupled to the support. The center of the partial loop portion is the axis of rotation of the arcuate portion. The arcuate portion is further configured to rotate between an inlet position that allows a toy vehicle to enter the stunt loop apparatus and travel along the partial loop portion and an outlet position that allows a toy vehicle traveling along the partial loop portion to exit the stunt loop apparatus.

When the arcuate portion is in the outlet position, the arcuate portion blocks a toy vehicle from entering the stunt loop apparatus. Further, when the arcuate portion is in the inlet position, the arcuate portion blocks a toy vehicle from exiting the stunt loop apparatus. The arcuate portion is configured to rotate from the inlet position to the outlet position in the absence of a toy vehicle on the arcuate portion. The arcuate portion is further configured to rotate from the inlet position to the outlet position while a toy vehicle is traveling along the partial loop portion. The arcuate portion is configured to rotate from the inlet position to the outlet position to receive a toy vehicle that is traveling along the partial loop portion. Furthermore, the stunt loop apparatus is configured to allow a toy vehicle to travel along the partial loop portion in a direction opposite to the direction the arcuate portion rotates from the inlet position to the outlet position. In certain instances, the partial loop portion includes a switch that triggers the arcuate portion to rotate from the inlet position to the outlet position.

In accordance with other embodiments of the present invention, the toy vehicle playset further comprises a housing for retaining one or more toy vehicles. The stunt loop apparatus is movably connected to the housing. The stunt loop apparatus moves between a closed position that blocks the one or more toy vehicles retained in the housing from being released and an open position that allows the one or more toy vehicles retained in the housing to be released. In certain instances, the stunt loop apparatus pivots from the closed position to the open position when a release mechanism in the stunt loop apparatus is triggered by a toy vehicle traveling along the partial loop portion.

In accordance with another embodiment of the present invention, a toy vehicle playset is provided that comprises a stunt loop apparatus having a support, a partial loop portion coupled to the support, and an arcuate portion rotatably coupled to the support. The partial loop portion has an opening and the arcuate portion is configured to rotate between an inlet position and an outlet position within the opening. The toy vehicle playset further comprises a housing for releasably storing one or more toy vehicles. The housing is hingedly connected to the stunt loop apparatus such that the stunt loop apparatus pivots between a closed position that blocks the one or more toy vehicles stored in the housing from being released and an open position that allows the one or more toy vehicles stored in the housing to be released. By rotating the arcuate portion from the inlet position to the outlet position, a continuous pathway is formed that allows a toy vehicle to sequentially travel along the arcuate portion in the inlet position, the partial loop portion, and the arcuate portion in the outlet position.

Other objects, features and advantages of the present invention will become apparent to those skilled in the art from the following detailed description. It is to be understood, however, that the detailed description and specific examples, while indicating some embodiments of the invention, are given by way of illustration and not limitation. Many changes and modifications within the scope of the invention may be made without departing from the spirit thereof, and the present invention includes all such modifications.

BRIEF DESCRIPTION OF THE DRAWINGS

Referring now to the drawings in which like reference numbers represent corresponding parts throughout:

FIG. 1A illustrates a toy vehicle entering a stunt loop apparatus while an arcuate portion of the stunt loop apparatus is in an inlet position. FIG. 1B illustrates the toy vehicle performing a loop while traveling along a partial loop portion of the stunt loop apparatus. FIG. 1C illustrates the toy vehicle continuing to travel along the partial loop portion while the arcuate portion is in an outlet position.

FIG. 1D illustrates the toy vehicle exiting the stunt loop apparatus. FIG. 1E illustrates a top view of the stunt loop apparatus;

FIG. 3A illustrates a front view of the toy vehicle playset where an arcuate portion of the stunt loop apparatus is in an outlet position. FIG. 3B illustrates a front view of the toy vehicle playset where the arcuate portion is rotated to an inlet position by turning a handle on the stunt loop apparatus. FIG. 3C illustrates a rear perspective view of the engagement between the handle and the arcuate portion. FIG. 3D illustrates a rear view of the toy vehicle playset;

FIG. 4A illustrates the stunt loop apparatus with a toy vehicle traveling along a partial loop portion while the arcuate portion is in the inlet position. FIG. 4B illustrates the stunt loop apparatus with the toy vehicle traveling along the partial loop portion while the arcuate portion is in the outlet position;

FIG. 5A illustrates a front view of the toy vehicle playset. FIG. 5B illustrates a rear view of the toy vehicle playset.

DETAILED DESCRIPTION OF THE INVENTION

Figure 1A:
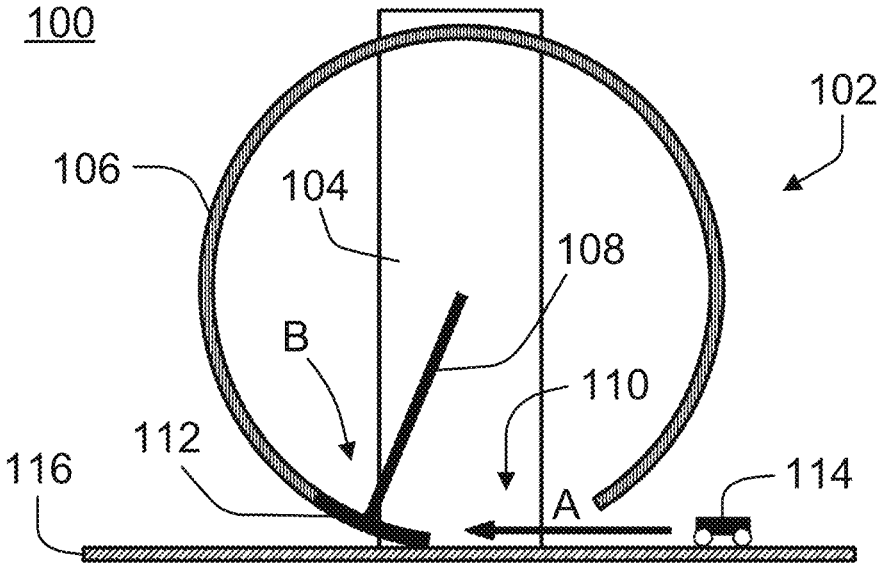
FIGS. 1A-1E illustrate a general schematic of a toy vehicle playset, in accordance with an embodiment of the invention.

A toy vehicle playset according to the present invention includes a stunt loop apparatus that allows a toy vehicle to perform a loop while interacting with the toy vehicle playset. FIGS. 1A-1D provide a general schematic of a toy vehicle playset 100 with a stunt loop apparatus 102. The stunt loop apparatus 102 has a support 104 that supports a partial loop portion 106 and an arcuate portion 108 in a vertical orientation. The partial loop portion 106 has an opening or gap 110 and a section 112 of the arcuate portion 108 is positioned to rotate within the opening or gap 110. The arcuate portion 108 is aligned to the partial loop portion 106 such that the partial loop portion 106 and the arcuate portion 108 provide a generally smooth and continuous track surface for a toy vehicle to travel along.

Figure 1B:
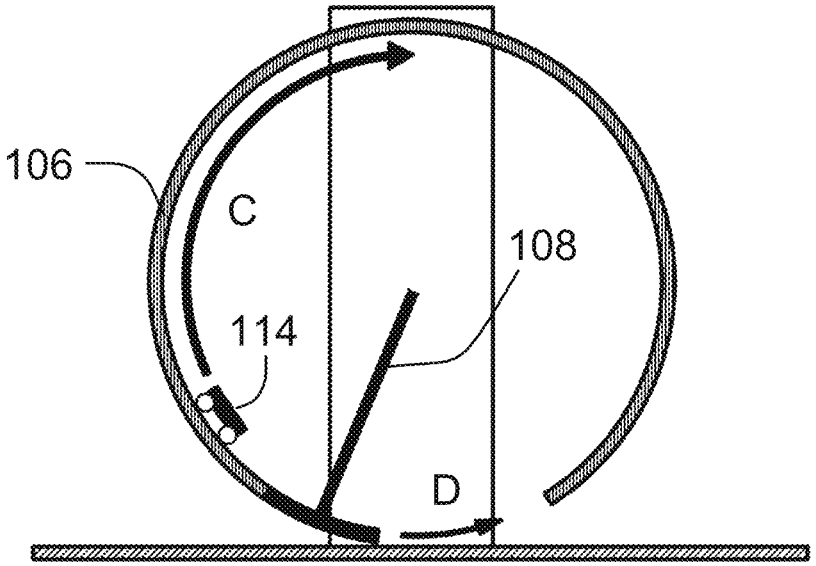
Figure 1C:
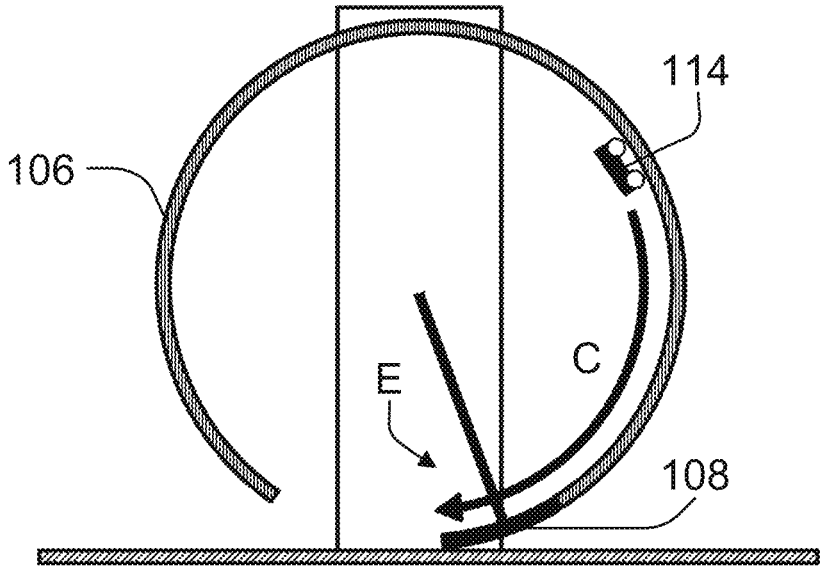
Figure 1D:
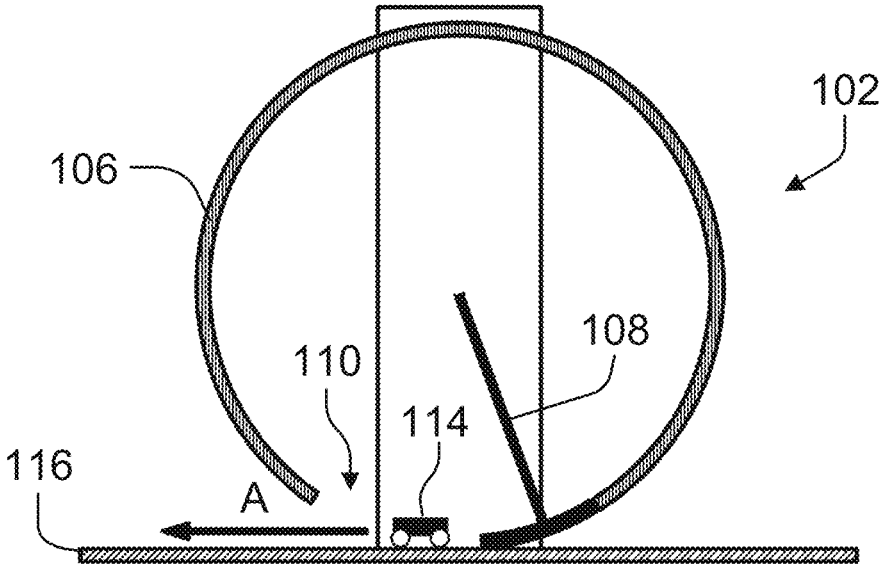

FIG. 1A depicts a toy vehicle 114 traveling along a track segment 116 in a direction A while the arcuate portion 108 is in an inlet position B. The opening 110 of the partial loop portion 106 allows the toy vehicle 114 to enter the stunt loop apparatus 102 and travel onto the arcuate portion 108. FIG. 1B depicts the toy vehicle 114 continuing to travel from the arcuate portion 108 onto the partial loop portion 106 in the direction C. While the toy vehicle 114 is traveling along the partial loop portion 106, the arcuate portion 108 rotates in a direction D (opposite from direction C). FIG. 1C depicts the arcuate portion 108 having rotated to an outlet position E while the toy vehicle 114 is still traveling along the partial loop portion 106 in the direction C. With the arcuate portion 108 in the outlet position E, the toy vehicle 114 travels back onto the arcuate portion 108. FIG. 1D depicts the toy vehicle 114 having traveled from the arcuate portion 108 back onto the track segment 116. The toy vehicle 114 continues traveling in the direction A and exits the stunt loop apparatus 102 through the opening 110 of the partial loop portion 106. The arcuate portion 108 may then be rotated back to the inlet position B (as shown in FIG. 1A) for additional toy vehicles to perform the same looping action in the stunt loop apparatus 102.

As described above, the partial loop portion 106 and rotating arcuate portion 108 provide a continuous pathway that allows the toy vehicle 114 to sequentially travel along the arcuate portion 108 in the inlet position B, the partial loop portion 106, and then back onto the arcuate portion 108 in the outlet position E. Thus, a toy vehicle is able to perform a full 360 degrees loop even though the stunt loop apparatus 102 does not include a fixed, complete loop structure.

Figure 1E:
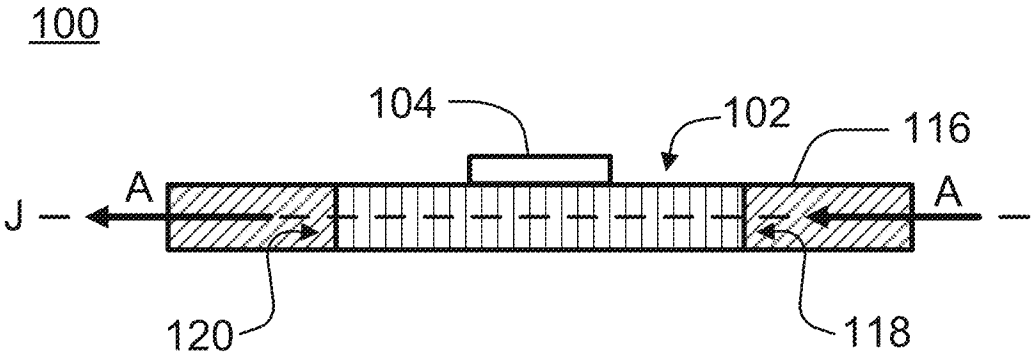

Furthermore, as shown in FIG. 1E, the toy vehicle playset 100 allows a toy vehicle to enter and exit the stunt loop apparatus 102 through a respective inlet 118 and outlet 120 that are collinear/in-line with each other. A toy vehicle travels into the stunt loop apparatus 102 in direction A and leaves the stunt loop apparatus 102 also in the same direction A, which forms a straight pathway J through the stunt loop apparatus 102. Traditional vertically-oriented loops typically involve a loop structure where a toy vehicle enters and exits the loop structure through a respective inlet and outlet that are offset from each other. In instances where a raceway is constructed by coupling multiple interchangeable track segments together, the offset entrance and exit pathways make it difficult to switch the loop segment with other track segments that do not have offset inlets and outlets, such as a straight track segment. Consequently, the amount of raceway configurations available to a track set with interchangeable track segments becomes limited. In contrast, by having a collinear/in-line inlet and outlet, the stunt loop apparatus described herein can be easily interchanged with other track segments with in-line inlets and outlets to form a variety of raceway layouts.

Figure 2:
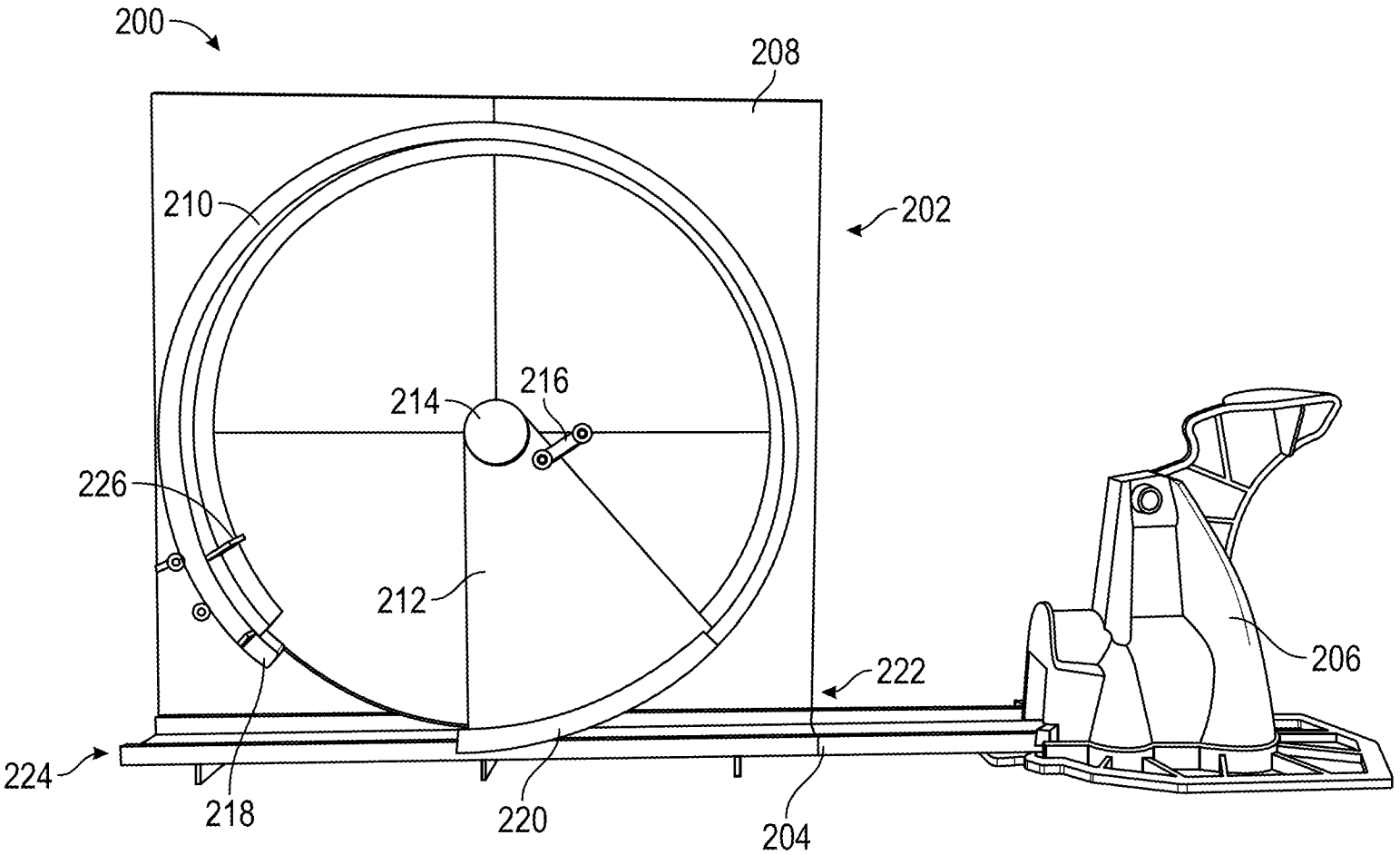
FIG. 2 illustrates a toy vehicle playset with a stunt loop apparatus, in accordance with another embodiment of the invention.

Referring now to FIG. 2, an illustrative embodiment of the toy vehicle playset is shown. Toy vehicle playset 200 includes a stunt loop apparatus 202 connected to a straight track segment 204 and a toy vehicle launcher 206. The stunt loop apparatus 202 has a support 208 with a partial loop portion 210 and a rotating arcuate portion 212 mounted to the support 208. Typically, the partial loop portion 210 is longer in length than the arcuate portion 212, though in some embodiments, the partial loop portion 210 is shorter or equal in length to the arcuate portion 212. The rotating arcuate portion 212 has an axis of rotation 214 that is at the center of the partial loop portion 210 and is configured to rotate between an inlet position (not shown) and an outlet position (shown in FIG. 2). A biasing member or spring 216 is connected to the support 208 and to the arcuate portion 212 and biases the arcuate portion 212 to its outlet position. An arcuate portion latch 218 prevents the arcuate portion 212 from rotating to the outlet position while the arcuate portion 212 is in the inlet position.

While the arcuate portion 212 is in the inlet position, a toy vehicle launched from launcher 206 can enter the stunt loop apparatus 202 and travel along a track section 220 of the arcuate portion 212 and the partial loop portion 210. The track section 220 of the arcuate portion 212 is concentric to the partial loop portion 210, with the partial loop portion 210 and the track section 220 of the arcuate portion 212 having the same radius of curvature. This configuration or arrangement provides a generally smooth track surface between the partial loop portion 210 and the arcuate portion 212 in both the inlet and outlet positions. Additionally, the straight track segment 204 is positioned tangentially to the arcuate portion 212 so that a toy vehicle traveling on the straight track segment 204 is able to smoothly transition from the straight track segment 204 onto the arcuate portion 212 in the inlet position and also from the arcuate portion 212 in the outlet position back onto the straight track segment 204. Instead of the toy vehicle launcher 206, other apparatuses, mechanisms, and/or track segments may also be connected to the inlet end 222 and/or outlet end 224 of the stunt loop apparatus 202.

When a toy vehicle travels along the partial loop portion 210, the toy vehicle passes through a switch 226 that triggers the arcuate portion latch 218 to release the arcuate portion 212 while it is in the inlet position. The spring 216 causes the arcuate portion 212 to then rotate from the inlet position to the outlet position while the toy vehicle is still traveling along the partial loop portion 210. Thus, the arcuate portion 212 rotates from the inlet position to the outlet position in the absence of a toy vehicle on the arcuate portion 212. The amount of time required for the arcuate portion 212 to rotate from the inlet position to the outlet position is preferably less than or equal to the time required for a toy vehicle to travel along the full length of the partial loop portion 210. By rotating faster than or equal to the time it takes for a toy vehicle to travel along the partial loop portion 210, the arcuate portion 212 is able to receive the toy vehicle when it finishes traveling along the partial loop portion 210. While the arcuate portion 212 is in the outlet position, a toy vehicle traveling along the partial loop portion 210 can then travel back onto the arcuate portion 212 and continue along to the straight track segment 204 to exit the stunt loop apparatus 202.

In one or more embodiments, a user manually moves the arcuate portion against the biasing force of the spring or other biasing member to the inlet position. Other manual or motorized mechanisms may also be used to move the arcuate portion from the outlet position to the inlet position.

Figure 3A:
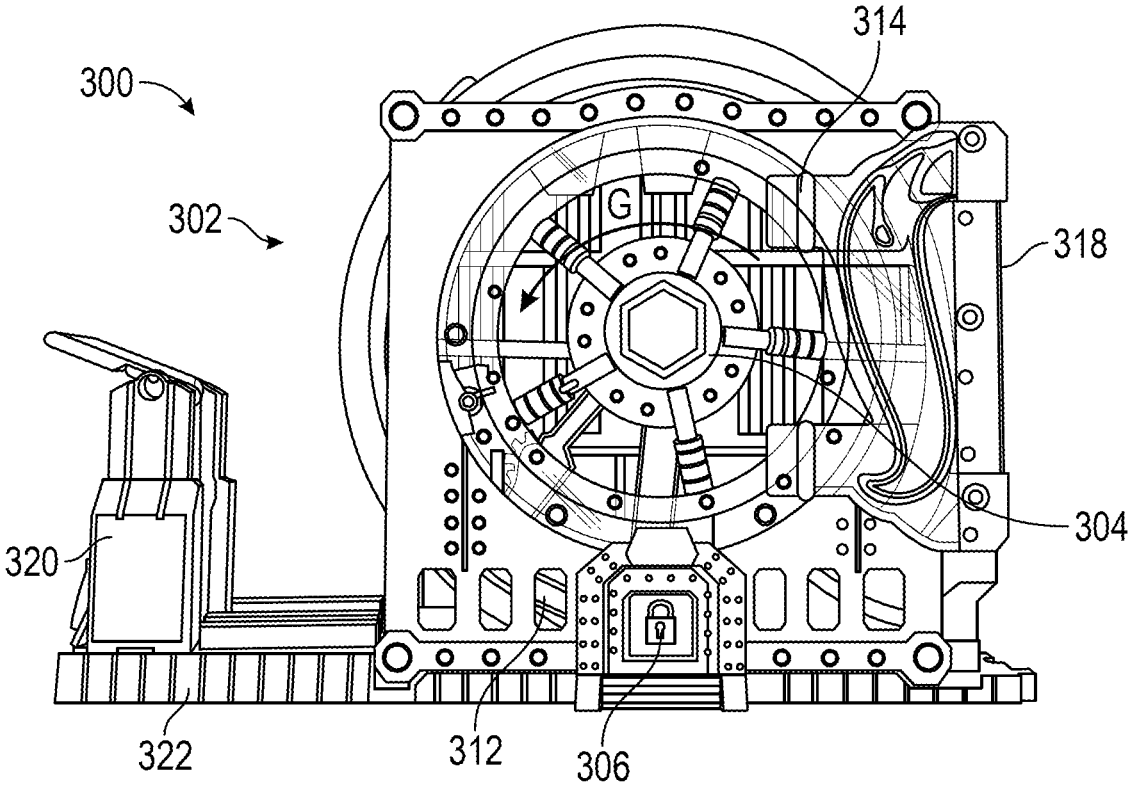
FIGS. 3A-3D illustrate a toy vehicle playset with a stunt loop apparatus in a closed position, in accordance with another embodiment of the invention.
Figure 3B:
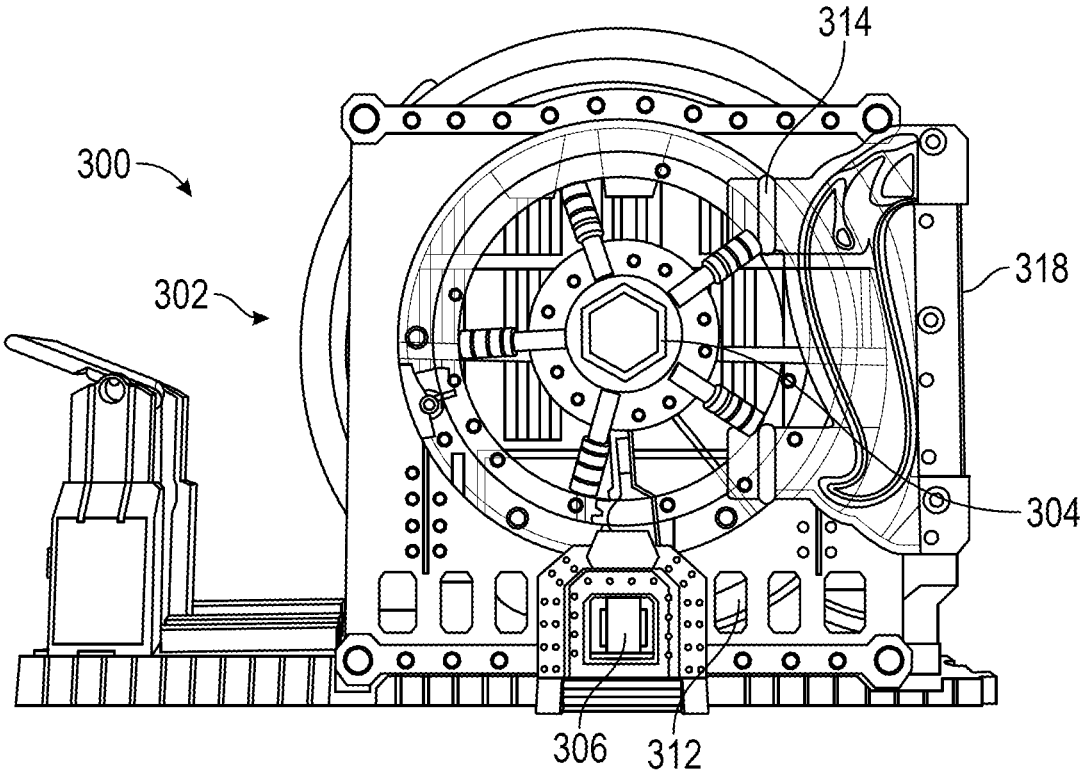

In the illustrative embodiment shown in FIGS. 3A and 3B, a toy vehicle playset 300 includes a handle 304 located on one side of a stunt loop apparatus 302. In this exemplary implementation, the toy vehicle playset 300 is based on a bank vault theme and the handle 304 is a 5-spoke handle that represents a vault door handle. Turning the handle 304 in a counter-clockwise direction G rotates an arcuate portion 312 of the stunt loop apparatus 302 from the outlet position to the inlet position. A visual indicator 306 on the stunt loop apparatus 302 indicates whether the arcuate portion 312 is in the outlet position (see FIG. 3A) or in the inlet position (see FIG. 3B). In the instant embodiment, a locked symbol on the visual indicator 306 signifies that the "bank vault" is locked and toy vehicles cannot be launched into the stunt loop apparatus 302 (i.e., blocked by the arcuate portion 312 in the outlet position). An unlocked symbol on the visual indicator 306 signifies that the "bank vault" is ready to be unlocked and a toy vehicle may be launched into the stunt loop apparatus 302 (i.e., the arcuate portion 312 is in the inlet position).

Figure 3C:
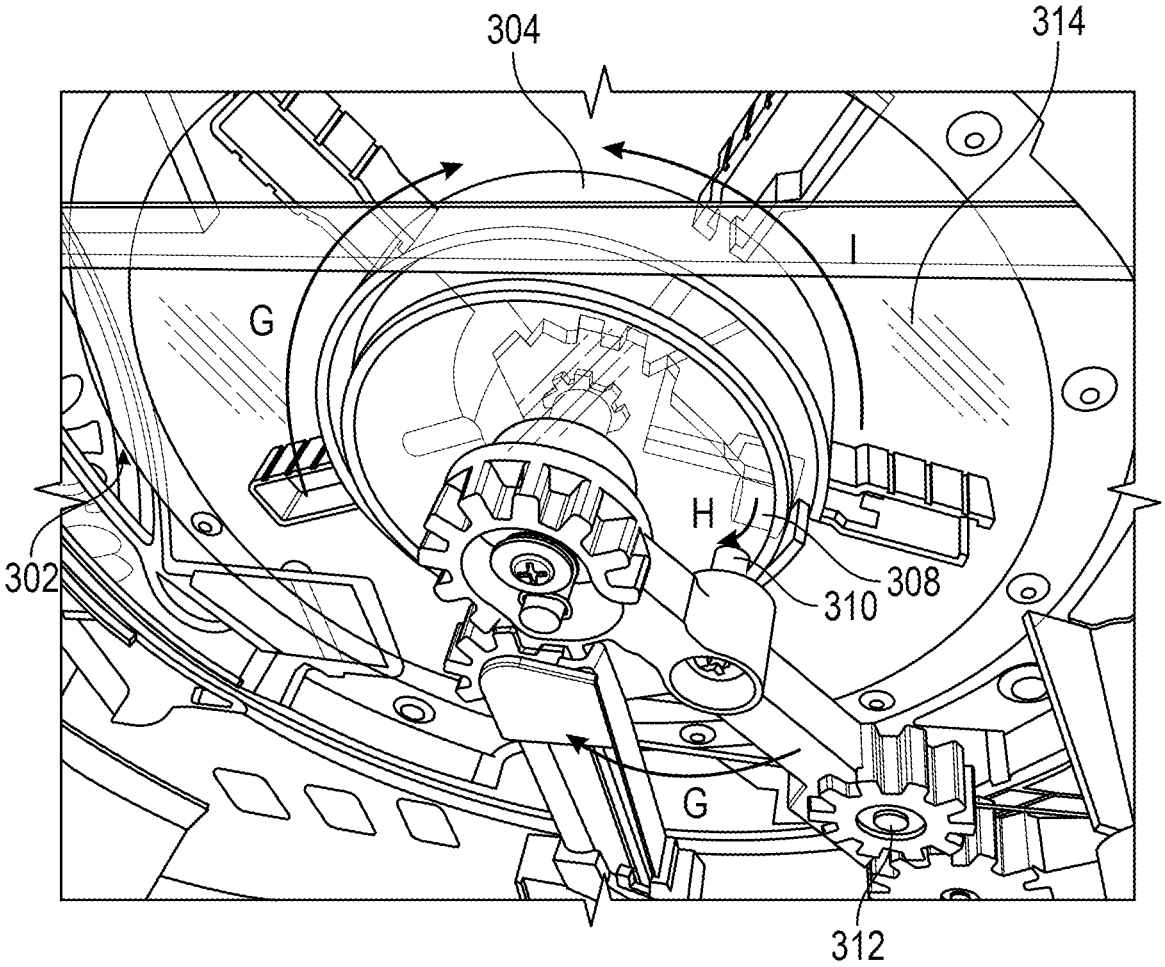

As shown in FIG. 3C, one side of the handle 304 includes a flapper 308 that engages with a protrusion 310 on the arcuate portion 312. The arcuate portion 312 is mounted to a support 314 that includes an open channel for the protrusion 310 on the arcuate portion 312 to extend through the support 314 and engage with the flapper 308 on the handle 304. As the handle 304 is turned in the direction G, the flapper 318 pushes the protrusion 310 to rotate the arcuate portion 312 in the same direction G (i.e., from the outlet position to the inlet position). Once the arcuate portion 312 has been rotated to the inlet position, the arcuate portion 312 is unable to rotate any further, which also prevents the handle 304 from being further turned.

In certain instances, the flapper 308 on the handle 304 is configured to pivot in a single direction away from a default position of being generally perpendicular to the handle 304. By allowing the flapper 308 to pivot, the handle 304 can spin in a specific direction more than 360 degrees and not be obstructed by the protrusion 310 on the arcuate portion 312. In the instant embodiment shown in FIG. 3C, the flapper 308 pivots in a direction H, which allows the handle 304 to freely spin in a direction I. Because the flapper 308 can only pivot in direction H, when the handle is turned in direction G, the flapper 308 is still able to push the protrusion 310 in direction G and move the arcuate portion 312 from the outlet position to the inlet position. Moreover, when the arcuate portion 312 rotates from the inlet position to the outlet position, the protrusion 310 on the arcuate portion 312 pushes the flapper 308 in direction I to cause the handle 304 to freely spin.

In one or more embodiments, the stunt loop apparatus is connected or coupled to additional track elements, mechanisms or apparatuses. For example, in one or more embodiments, the stunt loop apparatus is connected to a toy vehicle housing. In the illustrative embodiment shown in FIGS. 3A-3D, the stunt loop apparatus 302 is connected to a housing 316 via a hinge 318 (see FIGS. 3A-3B). The hinge 318 allows the stunt loop apparatus 302 to pivot between a closed position (see, e.g., FIGS. 3A-3D) and an open position (see, e.g., FIGS. 5A-5B). In keeping with the bank vault theme of the illustrative embodiment shown for example in FIGS. 3A-3D, the stunt loop apparatus 302 represents a bank vault door that restricts access to the toy vehicle housing 316, which represents a bank vault.

While the stunt loop apparatus 302 is in the closed position (see, e.g., FIGS. 3A-3D), the toy vehicle playset 300 is in a stunt configuration, which provides the opportunity for a toy vehicle to interact with the stunt loop apparatus 302. If the arcuate portion 312 of the stunt loop apparatus 302 is in the inlet position, a toy vehicle can then be launched by a launcher 320 and travel along a track segment 322 into the stunt loop apparatus 302. However, if the arcuate portion 312 is in the outlet position, the arcuate portion 312 will block toy vehicles traveling along track segment 322 from entering the stunt loop apparatus 302.

Figure 4A:
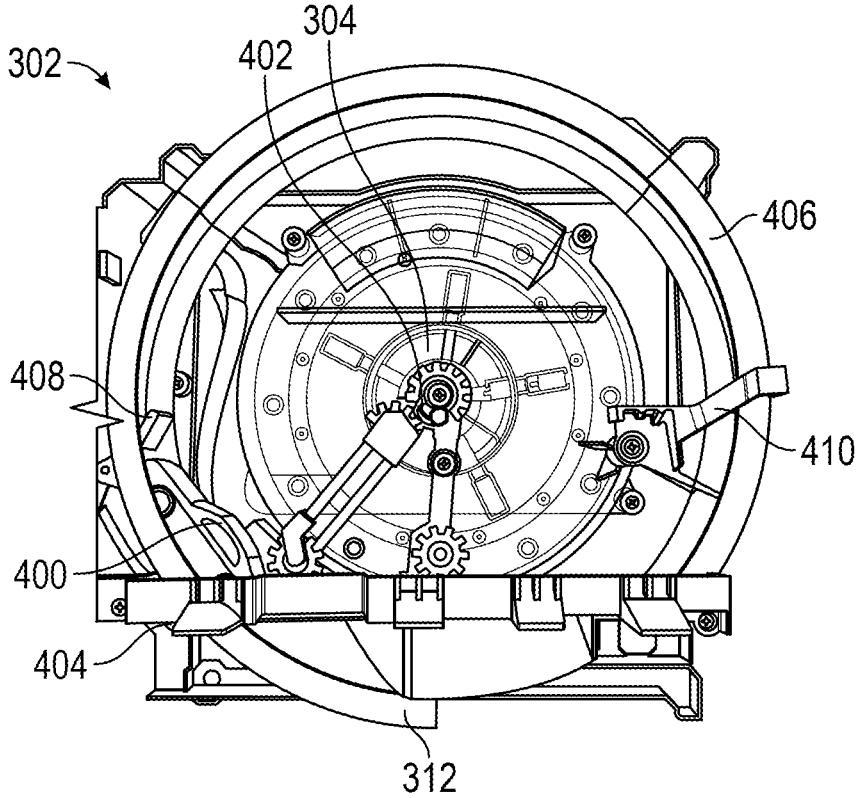
FIGS. 4A-4B illustrate the stunt loop apparatus of the toy vehicle playset of FIGS. 3A-3D, in accordance with an embodiment of the invention.
Figure 4B:
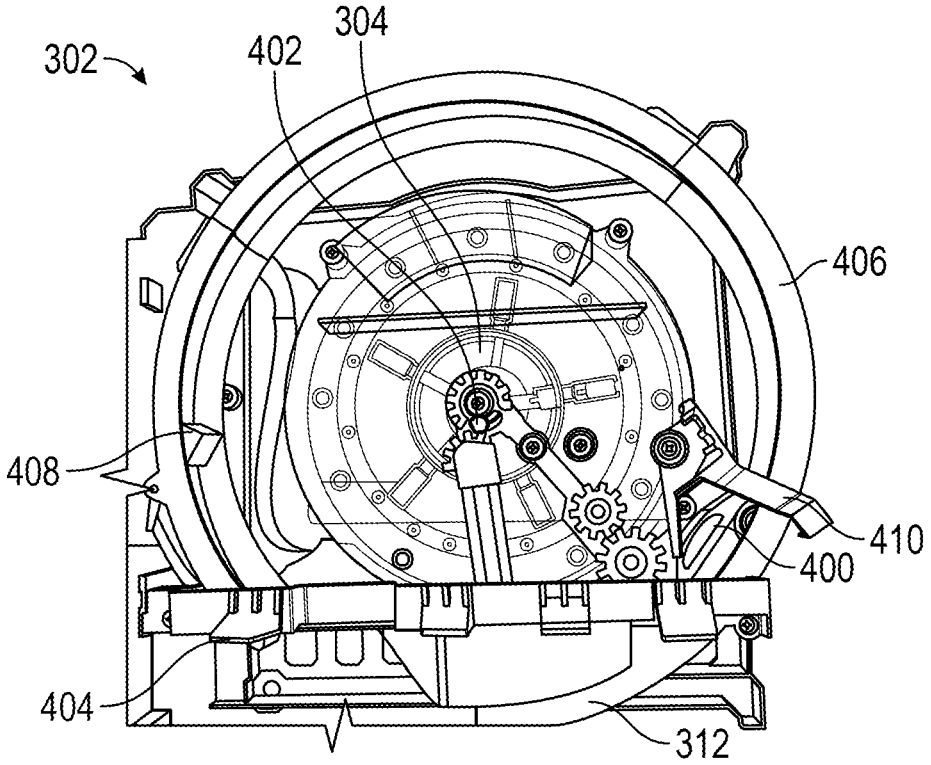

FIGS. 4A-4B provide an illustration of the interaction between a toy vehicle 400 and the stunt loop apparatus 302 while the stunt loop apparatus 302 is in the closed position. In FIG. 4A, the arcuate portion 312 is shown in its inlet position and in FIG. 4B, the arcuate portion 312 is shown in its outlet position. A coiled spring 402 located near the center of the stunt loop apparatus 302 biases the arcuate portion 312 to the outlet position (see, e.g., FIG. 4B). As described above, the handle 304 on the outside of the stunt loop apparatus 302 may be turned to rotate the arcuate portion 312 from its outlet position to its inlet position. When the arcuate portion 312 is moved to the inlet position, an arcuate portion latch 404 prevents the arcuate portion 312 from rotating back to the outlet position.

Figure 3D:
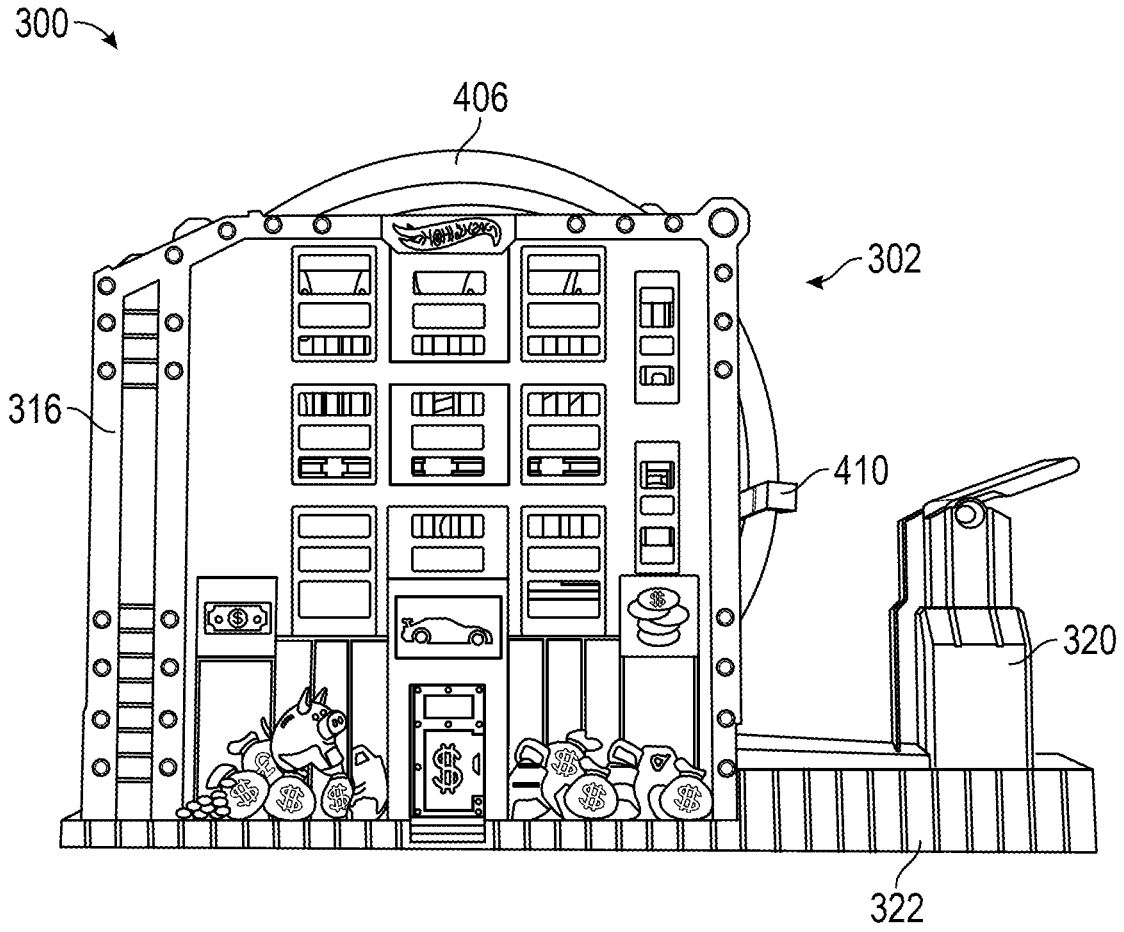

As the toy vehicle 400 travels from the arcuate portion 312 to the partial loop portion 406 of the stunt loop apparatus 302, the toy vehicle 400 passes through a switch 408 on the partial loop portion 406 that triggers the arcuate portion latch 404 to release the arcuate portion 312 (see FIGS. 3D and 4A). The coiled spring 402 causes the arcuate portion 312 to swiftly rotate to the outlet position while the toy vehicle 400 continues to travel along the partial loop portion 406. Additionally, the movement of the arcuate portion 312 from the inlet position to the outlet position spins the handle 304.

Before the toy vehicle 400 travels from the partial loop portion 406 onto the arcuate portion 312 in the outlet position, the toy vehicle 400 passes through a housing latch 410 on the partial loop portion 406 (see FIGS. 3D and 4B). While the playset 300 is in the stunt configuration, the housing latch is 410 engaged with a catch 412 on the housing 316 (see, e.g., FIG. 5A) to keep the stunt loop apparatus 302 in the closed position. When the toy vehicle 400 passes through the housing latch 410 on the partial loop portion 406, the housing latch 410 disengages from the catch 412, which allows the stunt loop apparatus 302 to move to the open position. The housing latch 410 may also be accessed from outside the stunt loop apparatus 302 to disengage the stunt loop apparatus 302 from the housing 316 (see, e.g., FIG. 3D). After passing through the housing latch 410, the toy vehicle 400 travels onto the arcuate portion 312 in the outlet position and exits the stunt loop apparatus 302.

FIGS. 4A-4B depict a toy vehicle 400 completing a successful loop by entering the stunt loop apparatus 302, passing through both the arcuate portion latch 404 and housing latch 410, and exiting the stunt loop apparatus 302. However, in certain embodiments of the toy vehicle playset, a toy vehicle traveling through the stunt loop apparatus is not guaranteed to successfully complete a loop every time. For example, a toy vehicle may be traveling too slow when it approaches the stunt loop apparatus and thus fails to have sufficient momentum to perform a loop or pass through the arcuate portion latch or housing latch. Therefore, the stunt loop apparatus provides a challenging gameplay aspect to the toy vehicle playset.

Figure 5A:
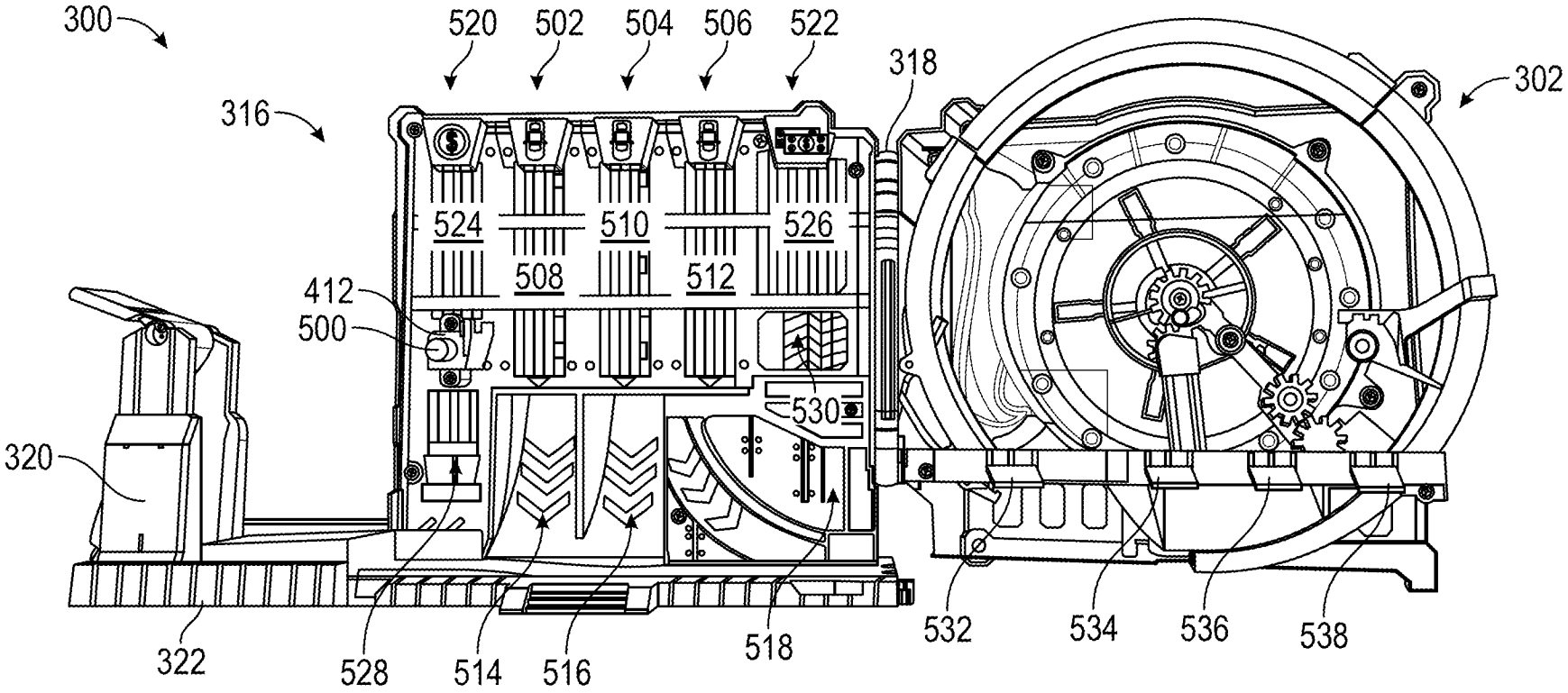
FIGS. 5A-5B illustrate the toy vehicle playset of FIGS. 3A-3D with the stunt loop apparatus in an open position, in accordance with an embodiment of the invention.

Referring to FIG. 5A, when the housing latch 410 disengages from the catch 412, a biasing member 500 on the housing 316 pushes the stunt loop apparatus 302 about the hinge 318, away from the housing 316, to the open position. While the stunt loop apparatus 302 is in the open position (see, e.g., FIGS. 5A-5B), the toy vehicle playset 300 is in a reward configuration, which provides a visual confirmation that a toy vehicle had successfully completed a loop within the stunt loop apparatus 302 (i.e., "unlocked" the bank vault).

Figure 5B:
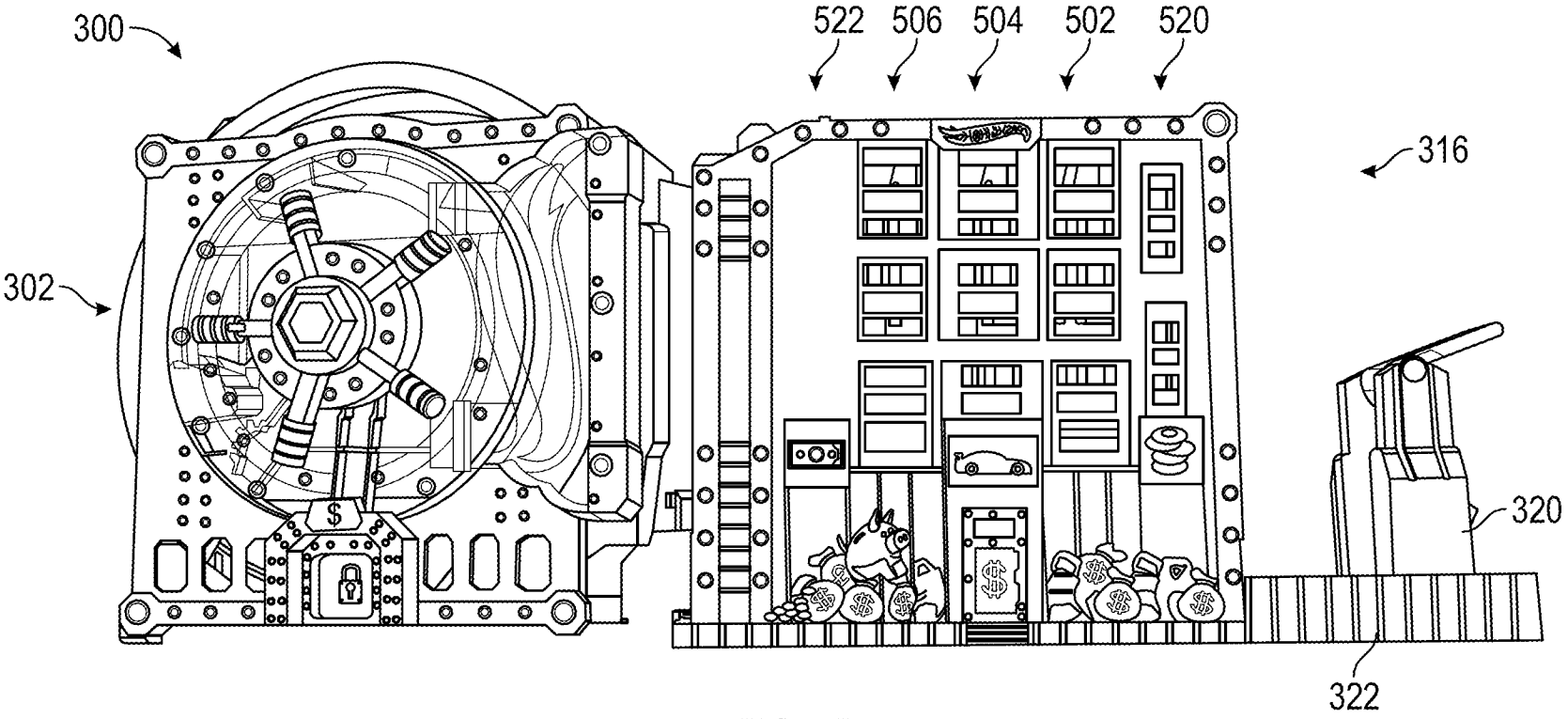

In the exemplary implementation shown in FIGS. 5A-5B, the housing 316 provides an enclosure in which one or more toy vehicles may be placed into the housing 316 through vehicle slots 502, 504, 506 on the top of the housing 316. The vehicle slots 502, 504, 506 are connected to respective tunnels 508, 510, 512 that lead to ramp exits 514, 516, 518 near the bottom of the housing 316. The vertical orientation of the tunnels 508, 510, 512 allow gravity to pull the toy vehicles downwards through the tunnels 508, 510, 512 and out of the housing 316 via the ramp exits 514, 516, 518. For example, a toy vehicle placed in vehicle slot 502 would travel through tunnel 508 and come out of ramp exit 514. Similarly, a toy vehicle placed in vehicle slot 504 would travel through tunnel 510 and come out of ramp exit 516. A toy vehicle placed in vehicle slot 506 would travel through tunnel 512 and come out of ramp exit 518. In the instant embodiment, the tunnels 508, 510, 512 do not cross paths with each another. In other embodiments, the tunnels may cross paths or lead to the same exit. Furthermore, the length of the tunnels 508, 510, 512 allow multiple toy vehicles to be placed in each tunnel 508, 510, 512.

The slots, tunnels, and exits may be any shape or size and allow objects other than toy vehicles to be placed into the housing 316. For example, additional token slots 520, 522 on top of the housing 316 are connected to respective tunnels 524, 526 that lead to exits 528, 530. In keeping with the bank vault theme, a coin-shaped token can be placed in token slot 520 to come out of exit 528 and a flat bill-shaped token can be placed into token slot 522 to come out of exit 530. In other embodiments, the housing may have other combinations of one or more slots/openings, tunnels, and exits.

While the toy vehicle playset 300 is in the stunt configuration (see, e.g., FIG. 3A), the stunt loop apparatus 302 is rotated about the hinge 318 and located adjacent to the housing 316 (i.e., closed position). In the closed position, the stunt loop apparatus 302 physically blocks the exits 514, 516, 518, 528, 530. Thus, any toy vehicle and/or token placed into the slots 502, 504, 506, 520, 522 is retained in the housing 316. After a toy vehicle successfully completes a loop within the stunt loop apparatus 302, the stunt loop apparatus 302 pivots away from the housing 316 (i.e., open position) and the toy vehicle playset 300 changes to the reward configuration (see, e.g., FIG. 5A). While the stunt loop apparatus 302 is in the open position, the tunnels 508, 510, 512, 524, 526 are unobstructed and toy vehicles and/or tokens are able to travel through the housing 316 due to gravity. Any toy vehicle and/or token previously retained inside the housing 316 while the toy vehicle playset 300 was in the stunt configuration also drop down to the exits 514, 516, 518, 528, 530 of the housing 316.

Figure 6:
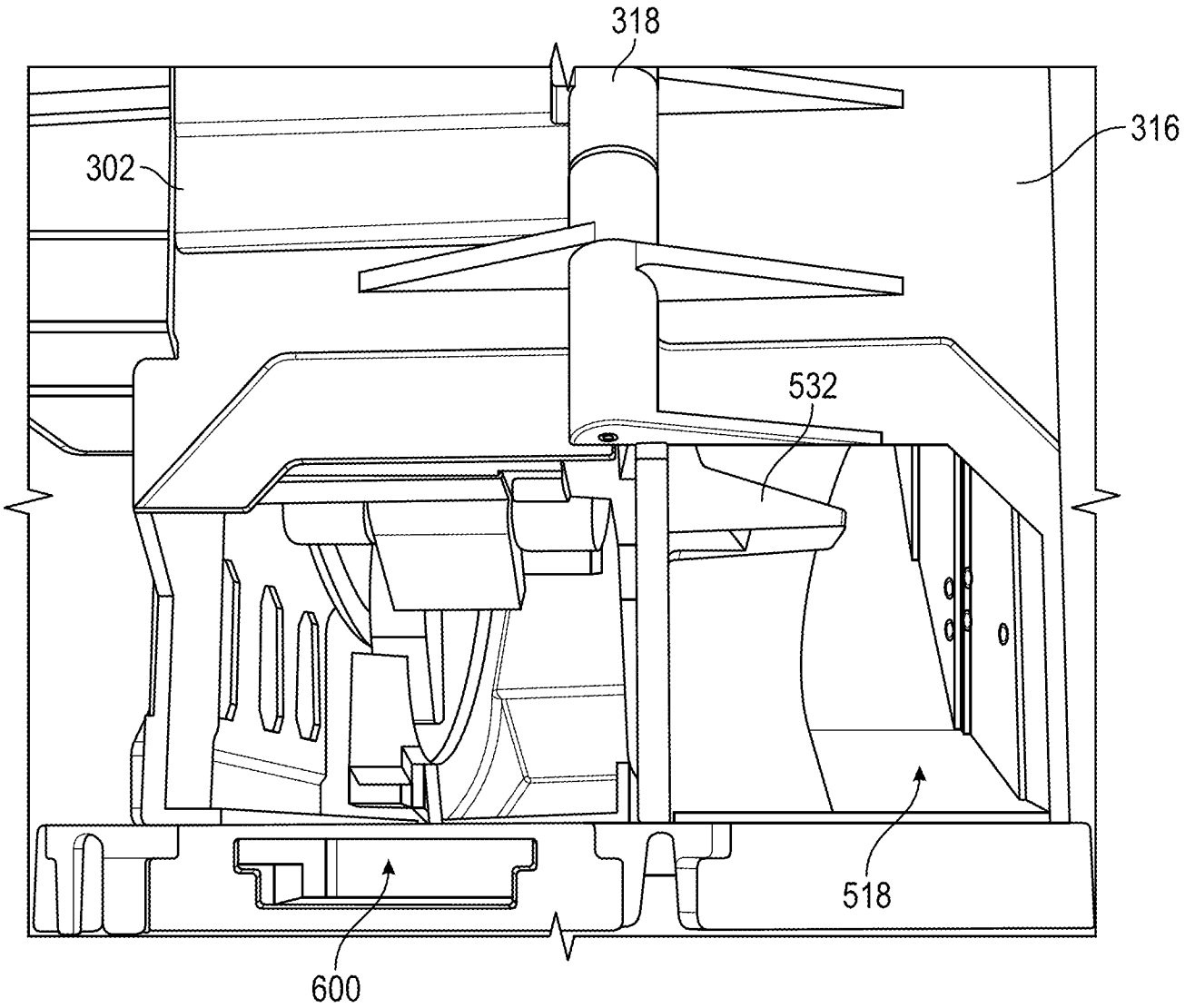
FIG. 6 illustrates a side view of the outlet of the toy vehicle playset of FIGS. 3A-3D with the stunt loop apparatus in the closed position, in accordance with an embodiment of the invention.

In the illustrative embodiment shown in FIG. 5A, the stunt loop apparatus 302 further includes projections 532, 534, 536, 538. The projections 532, 534, 536, 538 are positioned such that when the stunt loop apparatus 302 is in the closed position, the projections 532, 534, 536, 538 block the exits 514, 516, 518, 528 of the housing. For example, FIG. 6 shows a projection 532 blocking the ramp exit 518. When the stunt loop apparatus 302 moves to the open position, the projections 532, 534, 536, 538 move away from the exits 514, 516, 518, 528 and allow the toy vehicles and/or tokens to exit the housing 316. In the instant implementation, the projections 532, 534, 536, 538 are located at a distance above the bottom of the exits 514, 516, 518, 528 to allow the toy vehicles or tokens to fall a certain distance (such as along the angled portion of the ramp exit 514) when the stunt loop apparatus 302 moves to the open position.

Also shown in FIG. 6, the toy vehicle playset 300 includes a track connector 600 that allows for end-to-end connection or coupling with another track segment or component of a track set. In one or more embodiments, the track connector 600 is configured as a tongue-and-groove friction-fit connector or snap-together nesting tabs. A toy vehicle that has successfully passed through the stunt loop apparatus 302 may continue to travel along a track segment coupled to the toy vehicle playset 300. In other embodiments, a toy vehicle exiting the housing 316 through ramp exit 518 may also be directed to continue traveling along a track segment coupled to the toy vehicle playset 300.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims.

Moreover, it is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, the term "exemplary" may be used herein to describe an example or illustration. Any embodiment described herein as exemplary is not to be construed as a preferred or advantageous embodiment, but rather as one example or illustration of a possible embodiment of the invention.

Finally, various features from one of the embodiments may be incorporated into another of the embodiments. Accordingly, it is appropriate that the appended claims be construed broadly and in a manner consistent with the scope of the disclosure as set forth in the following claims.

The invention claimed is:

1. A toy vehicle playset, comprising:

a stunt loop apparatus having a support, a partial loop portion coupled to the support, and an arcuate portion rotatably coupled to the support and positioned concentric with the partial loop portion, the partial loop portion having an opening and the arcuate portion being configured to rotate between an inlet position and an outlet position within the opening;

wherein rotating the arcuate portion from the inlet position to the outlet position forms a continuous pathway that allows a toy vehicle to sequentially travel along the arcuate portion in the inlet position, the partial loop portion, and the arcuate portion in the outlet position.

2. The toy vehicle playset of claim 1, wherein the partial loop portion includes a switch that triggers the arcuate portion to rotate from the inlet position to the outlet position.

3. The toy vehicle playset of claim 1, wherein the arcuate portion in the outlet position blocks a toy vehicle from entering the stunt loop apparatus and the arcuate portion in the inlet position blocks a toy vehicle from exiting the stunt loop apparatus.

4. The toy vehicle playset of claim 1, wherein the arcuate portion is configured to rotate from the inlet position to the outlet position when the toy vehicle is not present on the arcuate portion.

5. The toy vehicle playset of claim 4, wherein the arcuate portion is configured to rotate from the inlet position to the outlet position while the toy vehicle is traveling along the partial loop portion.

6. The toy vehicle playset of claim 5, wherein the arcuate portion is configured to rotate from the inlet position to the outlet position to receive the toy vehicle traveling along the partial loop portion.

7. The toy vehicle playset of claim 1, wherein the stunt loop apparatus is configured to allow the toy vehicle to travel along the partial loop portion in a direction opposite to the direction the arcuate portion rotates from the inlet position to the outlet position.

8. The toy vehicle playset of claim 1, further comprising:

a housing for retaining one or more toy vehicles, the stunt loop apparatus being movably connected to the housing;

wherein the stunt loop apparatus moves between a closed position that blocks the one or more toy vehicles retained in the housing from being released and an open position that allows the one or more toy vehicles retained in the housing to be released.

9. The toy vehicle playset of claim 8, wherein the stunt loop apparatus pivots from the closed position to the open position when a release mechanism in the stunt loop apparatus is triggered by the toy vehicle traveling along the partial loop portion.

10. A toy vehicle playset, comprising:

a stunt loop apparatus having a support, a partial loop portion coupled to the support and having an opening that extends between an inlet of the partial loop portion and an outlet of the partial loop portion, and a rotating arcuate portion coupled to the support, wherein a focal point of the partial loop portion is an axis of rotation of the arcuate portion, wherein the arcuate portion configured to rotate between an inlet position that allows a toy vehicle to enter the stunt loop apparatus and travel along the partial loop portion and an outlet position that allows the toy vehicle traveling along the partial loop portion to exit the stunt loop apparatus.

11. The toy vehicle playset of claim 10, wherein the partial loop portion includes a switch that triggers the arcuate portion to rotate from the inlet position to the outlet position.

12. The toy vehicle playset of claim 10, wherein the arcuate portion in the outlet position blocks a toy vehicle from entering the stunt loop apparatus and the arcuate portion in the inlet position blocks a toy vehicle from exiting the stunt loop apparatus.

13. The toy vehicle playset of claim 10, wherein the arcuate portion is configured to rotate from the inlet position to the outlet position when the toy vehicle is not present on the arcuate portion.

14. The toy vehicle playset of claim 13, wherein the arcuate portion is configured to rotate from the inlet position to the outlet position while the toy vehicle is traveling along the partial loop portion.

15. The toy vehicle playset of claim 14, wherein the arcuate portion is configured to rotate from the inlet position to the outlet position to receive the toy vehicle traveling along the partial loop portion.

16. The toy vehicle playset of claim 10, wherein the stunt loop apparatus is configured to allow the toy vehicle to travel along the partial loop portion in a direction opposite to the direction the arcuate portion rotates from the inlet position to the outlet position.

17. The toy vehicle playset of claim 10, further comprising:

a housing for retaining one or more toy vehicles, the stunt loop apparatus being movably connected to the housing;

wherein the stunt loop apparatus moves between a closed position that blocks the one or more toy vehicles retained in the housing from being released and an open position that allows the one or more toy vehicles retained in the housing to be released.

18. The toy vehicle playset of claim 17, wherein the stunt loop apparatus pivots from the closed position to the open position when a release mechanism in the stunt loop apparatus is triggered by the toy vehicle traveling along the partial loop portion.

19. A toy vehicle playset, comprising:

a stunt loop apparatus having a support, a partial loop portion coupled to the support, and an arcuate portion rotatably coupled to the support, the partial loop portion having an opening and the arcuate portion being configured to rotate between an inlet position and an outlet position within the opening; and a housing for releasably storing one or more toy vehicles, the housing hingedly connected to the stunt loop apparatus such that the stunt loop apparatus pivots between a closed position that blocks the one or more toy vehicles stored in the housing from being released and an open position that allows the one or more toy vehicles stored in the housing to be released;

wherein rotating the arcuate portion from the inlet position to the outlet position forms a continuous pathway that allows a toy vehicle to sequentially travel along the arcuate portion in the inlet position, the partial loop portion, and the arcuate portion in the outlet position.

20. The toy vehicle playset of claim 19, wherein the stunt loop apparatus pivots from the closed position to the open position when a release mechanism in the stunt loop apparatus is triggered by the toy vehicle traveling along the partial loop portion.

* * * * *